US006705535B1

(12) United States Patent
Morton

(10) Patent No.: US 6,705,535 B1
(45) Date of Patent: Mar. 16, 2004

(54) SIDE ENTRY HUMIDIFIER

(75) Inventor: Willard E. Morton, Carver, MN (US)

(73) Assignee: Pure humidifier Co., Chaska, MN (US)

( * ) Notice: Subject to any disclaimer, the term of this patent is extended or adjusted under 35 U.S.C. 154(b) by 0 days.

(21) Appl. No.: 10/426,497

(22) Filed: Apr. 29, 2003

(51) Int. Cl.[7] ..... F24F 3/14
(52) U.S. Cl. ..... 237/78 R; 126/113
(58) Field of Search ..... 237/78 R, 78 A, 237/78 B; 126/113; 261/DIG. 10, DIG. 15, DIG. 34, DIG. 76; 392/324, 326, 329, 330, 331, 338

(56) References Cited

U.S. PATENT DOCUMENTS

| | | | | |
|---|---|---|---|---|
| 2,804,870 A | | 9/1957 | Chelini | |
| 2,860,228 A | * | 11/1958 | Boyle et al. | 392/399 |
| 2,993,107 A | | 7/1961 | Fichtner | |
| 3,087,485 A | | 4/1963 | Powers | |
| 3,219,795 A | * | 11/1965 | Wiseman | 392/402 |
| 3,664,324 A | | 5/1972 | Radtke | |
| 3,824,985 A | * | 7/1974 | Hetherington | 126/113 |
| 4,139,762 A | | 2/1979 | Pohrer et al. | |
| 4,239,956 A | | 12/1980 | Morton | |
| 4,697,735 A | * | 10/1987 | Temple | 236/44 C |
| RE33,414 E | | 10/1990 | Morton | |
| 5,140,667 A | | 8/1992 | Youngeberg | |
| 5,143,460 A | * | 9/1992 | Wang | 392/405 |
| 5,199,486 A | * | 4/1993 | Balmer et al. | 165/47 |
| 5,343,551 A | * | 8/1994 | Glucksman | 392/405 |
| RE34,739 E | * | 9/1994 | Nelson et al. | 126/113 |
| 5,609,296 A | | 3/1997 | Imamura et al. | |
| 5,616,115 A | * | 4/1997 | Gloyd et al. | 600/22 |
| 5,758,018 A | | 5/1998 | Fowler, Jr. | |
| 5,816,496 A | * | 10/1998 | Kovacs | 237/78 R |
| 5,835,678 A | * | 11/1998 | Li et al. | 392/401 |
| 5,855,823 A | | 1/1999 | MacGibbon et al. | |
| 5,873,357 A | * | 2/1999 | Lake | 126/113 |
| 6,078,729 A | * | 6/2000 | Kopel | 392/402 |
| 6,446,877 B1 | * | 9/2002 | Gaines et al. | 237/78 R |

OTHER PUBLICATIONS

PURE Humidifier Company, "Standard Water 'SX' Series Steam Heat Exchanger Humidifiers", Sheet Nos, SX–1–4.
PURE Humidifier Company, "Capacities and Piping 'SX' Series", Sheet Nos. SSX–2RC–3RC.
PURE Humidifier Company, "Capacities and Piping 'SX' Series", Sheet Nos. SSX–4RC–5RC.
Pure Humidifier Company "SX" with Intac Microprocessor Series Parts List & Two Year Recommended Spare Parts, 1 pg.
Diagram of SX Series Assembly with Intac, 1 pg.
PURE Humidifier Company, "Standard Water 'ES' Series Electric Humidifier", Sheet Nos. ES–1–2.
PURE Humidifier Company, "Dimensions & Layout 'ES' Series", Sheet Nos. ES–3–4.
PURE Humidifier Company, "Mounting Applications 'ES' Series", Sheet Nos. ES–5–6.
PURE Humidifier Company, "Options 'ES' Series", Sheet No. ES–9.

* cited by examiner

*Primary Examiner*—Derek Boles
(74) *Attorney, Agent, or Firm*—Nelson R. Capes; Gerald E. Helget; Briggs and Morgan

(57) ABSTRACT

A humidifier apparatus for building humidification. The apparatus includes a water reservoir with a removable cover, at least one aperture through a side wall of the water reservoir, a removable heat exchanger insertable into the aperture, and a steam exit.

10 Claims, 2 Drawing Sheets

SIDE ENTRY HUMIDIFIER

BACKGROUND OF THE INVENTION

The present invention relates to a humidifier and particularly to a humidifier in which the heating device is affixed to the humidification tank along one side and is removable from the humidification tank.

It is well known that forced air heating systems tend to create an atmosphere in a building space characterized by low relative humidity which leads to occupant discomfort and possible health problems, damage to wooden articles including furniture contained within the building, and discomfort caused by static electricity discharges. To obviate these problems, it is common practice to employ devices for adding moisture (humidity) to the air being forced through the building space. In this regard, a wide variety of devices are commonly employed. Examples of humidifiers that have been used in the past are U.S. Pat. Re. Nos. 33,414 and 5,816,496.

However, all previous humidifiers suffer from certain common problems. First, there is typically no easy access to the interior of the humidification tank for cleaning purposes. Second, the heating device is typically permanently attached to the humidification tank, and cannot easily be removed either for repair or replacement.

There is a need for a humidifier with a side entry configuration that addresses the above problems.

SUMMARY OF THE INVENTION

A humidifier apparatus for producing steam for building humidification, the apparatus comprising:

(a) a water reservoir having an open interior adapted to be filled with water, the water reservoir having an open top and a number of side walls enclosing the open interior, one of the side walls having an aperture therethrough into the open interior;

(b) a cover engaging the open top;

(c) a removable heat exchanger adapted to be inserted through the aperture into the open interior to produce steam from the water therein; and (d) a steam exit through which steam passes from the water reservoir into the ambient environment.

A principal object and advantage of the present invention is that the aperture in the side wall allows the interior to be accessed for cleaning without removing the top cover.

Another principal object and advantage of the present invention is that the heat exchanger is removable from the water reservoir for repair or replacement.

Another principal object and advantage of the present invention is that the humidifier can be installed in an environment with close tolerance between the cover and other objects, yet allow the interior of the water reservoir to be accessed through the side aperture.

Another principal object and advantage of the present invention is that it allows multiple heat exchangers to be stacked on top of one another within the water reservoir, and allows each heat exchanger to be individually accessed through the side apertures.

DETAILED DESCRIPTION OF THE PREFERRED EMBODIMENT

Figure 1:
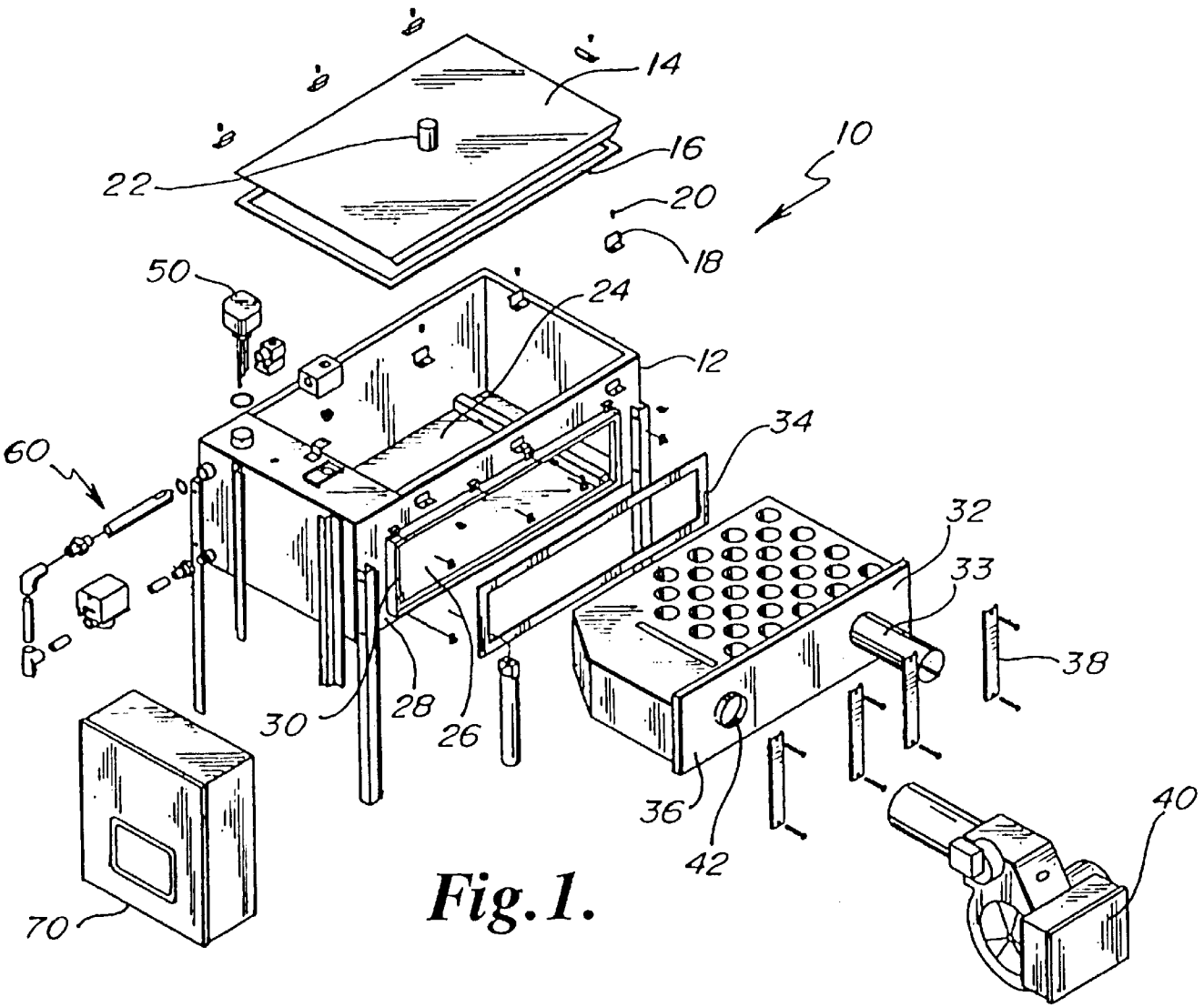
FIG. 1 is an exploded perspective view of a first embodiment of the humidifier apparatus of the present invention.

A first embodiment of a side entry humidifier of the present invention is generally shown in the Figures as reference numeral 10.

The side entry humidifier 10 further comprises a water reservoir 12 which may be filled with water to be used to produce steam for humidification. A reservoir cover 14 and cover gasket 16 may be removably attached to the reservoir 12 through cover clamps 18 and fasteners 20. Suitably, a steam pipe 22 may protrude from the cover 14 to allow steam to exit the reservoir 12.

The reservoir 12 has an open interior or core 24 which holds water for humidification. An access opening 26 extends through a side wall 28 of the reservoir 12, from the ambient environment into the interior or core 24. A flange or raised rim 30 preferably surrounds the access opening 26. the first embodiment 10, a heat exchanger 32 is removably mounted within the open interior or core 24. The heat exchanger 32 is inserted into and removed from the reservoir 12 through the access opening 26 in the side wall 28. A gasket 34 is preferably mounted against the flange 30 to seal between the flange 30 and a sealing plate 36 on the heat exchanger 32. A number of side wall clamps 38 engage the flange 30 to hold the heat exchanger 32 secure within the reservoir 12.

A gas burner unit 40 is removably mounted to the heat exchanger 32 so that the gas burner unit 40 is substantially outside the reservoir 12. Preferably, the gas burner unit 40 mounts to the heat exchanger 32 at connector 42. The gas burner unit 40 includes a blower (not shown) which forces hot air into the heat exchanger 32 to heat water in the reservoir 12. Exhaust gas from the heat exchanger 32 exits through the exhaust vent 33.

Humidifier 10 also preferably includes a water level sensor 50 which will prevent operation if the water level in the reservoir 12 falls below a pre-set point. In the case of models that use tap water, water level sensor 50 may be an electrical sensor. For humidifiers that use de-ionized water, the water level sensor 50 may be a float.

Humidifier 10 may also preferably include a flushing and draining assembly 60 to flush out and drain the reservoir 12, then refill it.

Humidifier 10 may also include a microprocessor control panel 70 which can be used by an operator to set up certain operational parameters for the humidifier 10. For example, the microprocessor control panel can be used in conjunction with the flushing and draining assembly 60 to automatically start draining the reservoir 12, then, after a configurable time, begin refilling the reservoir 12 with clean water.

The heat exchanger 32 can be accessed for cleaning by removing the reservoir cover 14. In addition, the heat exchanger 32 can be entirely removed from the reservoir 12 by loosening the side wall clamps 38 and sliding the heat exchanger 32 out of the reservoir 12. There are a number of situations in which the cover 14 is too close to another object, such as a duct or plenum, to be removed. In such situations, the heat exchanger 32 can only be accessed through the side access opening 26.

A customer may choose to use a different steam source, depending on the relative costs of electricity and gas. Thus, the heat exchanger 32 can be easily swapped out by the customer and replaced with an electric coil (not shown).

Figure 2:
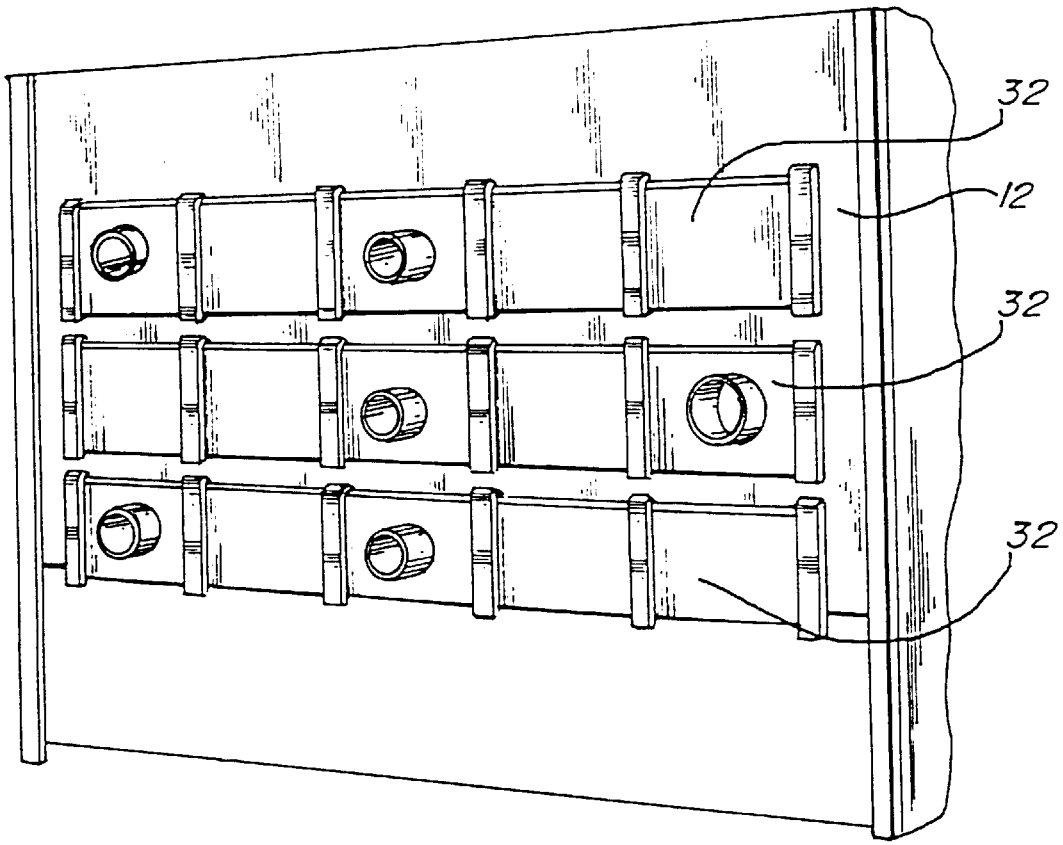
FIG. 2 is a side elevational view of a second embodiment of the humidifier apparatus of the present invention.

A second embodiment of the side entry humidifier is shown in FIG. 2. Several heat exchangers 32 may be stacked in a large reservoir, as shown in FIG. 2. Such stacking would not be possible without a side entry configuration, as the topmost units would need to be removed to access the lower units for cleaning, repair, or replacement. In the side entry configuration, each of the stacked units can be individually accessed.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A humidifier apparatus for producing steam for building humidification, the apparatus comprising:

(a) a water reservoir having an open interior adapted to be filled with water, the water reservoir having an open top and a number of side walls enclosing the open interior, one of the side walls having an aperture therethrough into the open interior;

(b) a cover engaging the open top;

(c) a removable heat exchanger insertable through the aperture into the open interior to produce steam from the water therein; and (d) a steam exit through which steam passes from the water reservoir into the ambient environment.

2. The apparatus of claim 1, wherein the cover is removable.

3. The apparatus of claim 1, further comprising a gas burner connected to the heat exchanger.

4. The apparatus of claim 3, wherein the gas burner is located outside the water reservoir.

5. A humidifier apparatus for producing steam for building humidification, the apparatus comprising:

(a) a water reservoir having an open interior adapted to be filled with water, the water reservoir having an open top and a number of side walls enclosing the open interior, one of the side walls having a plurality of apertures therethrough into the open interior;

(b) a cover engaging the open top;

(c) a plurality of removable heat exchangers insertable through the apertures into the open interior to produce steam from the water therein; and (d) a steam exit through which steam passes from the water reservoir into the ambient environment.

6. The apparatus of claim 5, wherein the cover is removable.

7. The apparatus of claim 5, further comprising a gas burner connected to the plurality of heat exchangers.

8. The apparatus of claim 7, wherein the gas burner is located outside the water reservoir.

9. A humidifier apparatus for producing steam for building humidification, the apparatus comprising:

(a) a water reservoir having an open interior adapted to be filled with water, the water reservoir having an open top and a number of side walls enclosing the open interior, one of the side walls having an aperture therethrough into the open interior;

(b) a removable cover engaging the open top;

(c) removable heat exchanger insertable through the aperture into the open interior to produce steam from the water therein, further comprising a gas burner connected to the heat exchanger, wherein the gas burner is located outside the water reservoir; and (d) a steam exit through which steam passes from the water reservoir into the ambient environment.

10. A humidifier apparatus for producing steam for building humidification, the apparatus comprising:

(a) a water reservoir having an open interior adapted to be filled with water, the water reservoir having an open top and a number of side walls enclosing the open interior, one of the side walls having a plurality of apertures therethrough into the open interior;

(b) a removable cover engaging the open top;

(c) a plurality of removable heat exchangers insertable through the apertures into the open interior to produce steam from the water therein, further comprising a gas burner connected to the plurality of heat exchangers, wherein the gas burner is located outside the water reservoir; and (d) a steam exit through which steam passes from the water reservoir into the ambient environment.

* * * * *